US006089889A

United States Patent [19]

Chiou et al.

[11] Patent Number: 6,089,889

[45] Date of Patent: Jul. 18, 2000

[54] CARD CARTRIDGE CONNECTOR WITH EJECTING MECHANISM

[75] Inventors: Song-Rong Chiou, Taipei Hsien; Chaur-Shiuh Chen, Tu-Chen; Jen-Jou Chang, Yung-Ho, all of Taiwan

[73] Assignee: Hon Hai Precision Ind. Co., Ltd., Taipei Hsien, Taiwan

[21] Appl. No.: 09/127,667

[22] Filed: Jul. 31, 1998

[30] Foreign Application Priority Data

Oct. 27, 1997 [TW] Taiwan ..... 86218204

[51] Int. Cl.[7] ..... H01R 13/62

[52] U.S. Cl. ..... 439/159; 439/160; 439/157

[58] Field of Search ..... 439/151, 152, 439/153, 154, 155, 156, 157, 158, 159, 160

[56] References Cited

U.S. PATENT DOCUMENTS 5,368,493 11/1994 O'Brien et al. ..... 439/160
5,456,610 10/1995 Banakis et al. ..... 439/157
5,655,918 8/1997 Soh ..... 439/159
5,863,212 1/1999 Duesterhoeft ..... 439/160
5,871,365 2/1999 Kajiura ..... 439/159
5,899,763 5/1999 Kajiura ..... 439/159

*Primary Examiner*—Renee Luebke
*Assistant Examiner*—Michael C. Zarroli

[57] ABSTRACT

A card cartridge connector having a card ejecting mechanism comprises a housing forming a mating face and a supporting face orthogonal to the mating face. A plurality of passageways each receiving a terminal therein is defined through the housing. A pair of guiding pillars extend from traverse ends of the housing and defines a receiving space therebetween. Each supporting pillar forms a guiding groove in an inner side thereof. At least a tunnel is defined in one of the guiding pillars. A card ejecting mechanism includes an ejecting tab movably supported on a fulcrum formed on the supporting face. The ejecting tab has a biasing pad detachably supported on the mating face. A push arm is movably disposed within the tunnel and forms a head and an actuating end. The actuating end abuts a bearing portion of the ejecting tab whereby when the push rod is actuated, the biasing pad is moved away from the mating face to push an inserted card outward.

10 Claims, 8 Drawing Sheets

CARD CARTRIDGE CONNECTOR WITH EJECTING MECHANISM

FIELD OF THE INVENTION

The present invention relates to a card cartridge connector, and more particularly to a smart card cartridge connector having a card ejecting mechanism whereby a card inserted therein can be easily ejected with a lower withdrawal force.

DESCRIPTION OF THE PRIOR ART

Electronic cards provide a plurality of functions and almost every digital electronic device has a built-in card cartridge connector in which a card can be inserted for data processing or transmission. For card cartridge connector having low pin density, only a recessed portion is provided adjacent to an entrance thereof and a user can only withdraw an inserted card through this recessed portion which is inconvenient.

Taiwan Utility Model application Nos. 83202198, 85218632, and U.S. Pat. Nos. 5,286,207, 5,290,174 and 5,334,046 disclose such card cartridge connectors. However, the conventional card cartridge connectors experience adverse defects during manufacture and operation. If the card does not properly sit in the card cartridge connector and establish an effective electrical connection therewith, the inserted card is rendered functionless. On the other hand, if a user inserts the card with an incorrect orientation, both the card and the card cartridge connector will become damaged.

SUMMARY OF THE INVENTION

An objective of this invention is to provide a cartridge having a card ejecting mechanism therein for facilitating withdrawal of an inserted card.

Another objective of this invention it to provide a supporting pillar having a guiding groove serving as an anti-disorientation device to prevent incorrect insertion of the card.

The above objectives are achieved by providing a card cartridge connector having a card ejecting mechanism comprising a housing forming a mating face and a supporting face orthogonal to the mating face. A plurality of passageways each receiving a terminal therein is defined through the housing. A pair of guiding pillars extend from traverse ends of the housing and defines a receiving space therebetween. Each supporting pillar forms a guiding groove in an inner side thereof. At least a tunnel is defined in one of the guiding pillars. A card ejecting mechanism includes an ejecting tab movably supported on a fulcrum formed on the supporting face. The ejecting tab has a biasing pad detachably supported on the mating face. A push arm is movably disposed within the tunnel and forms a head and an actuating end. The actuating end abuts a bearing portion of the ejecting tab whereby when the push rod is actuated, the biasing pad is moved away from the mating face to push an inserted card outward.

These and additional objects, features, and advantages of the present invention will become apparent after reading the following detailed description of the preferred embodiments of the invention taken in conjunction with the appended drawings.

DETAILED DESCRIPTION OF THE PREFERRED EMBODIMENTS

Figure 1:
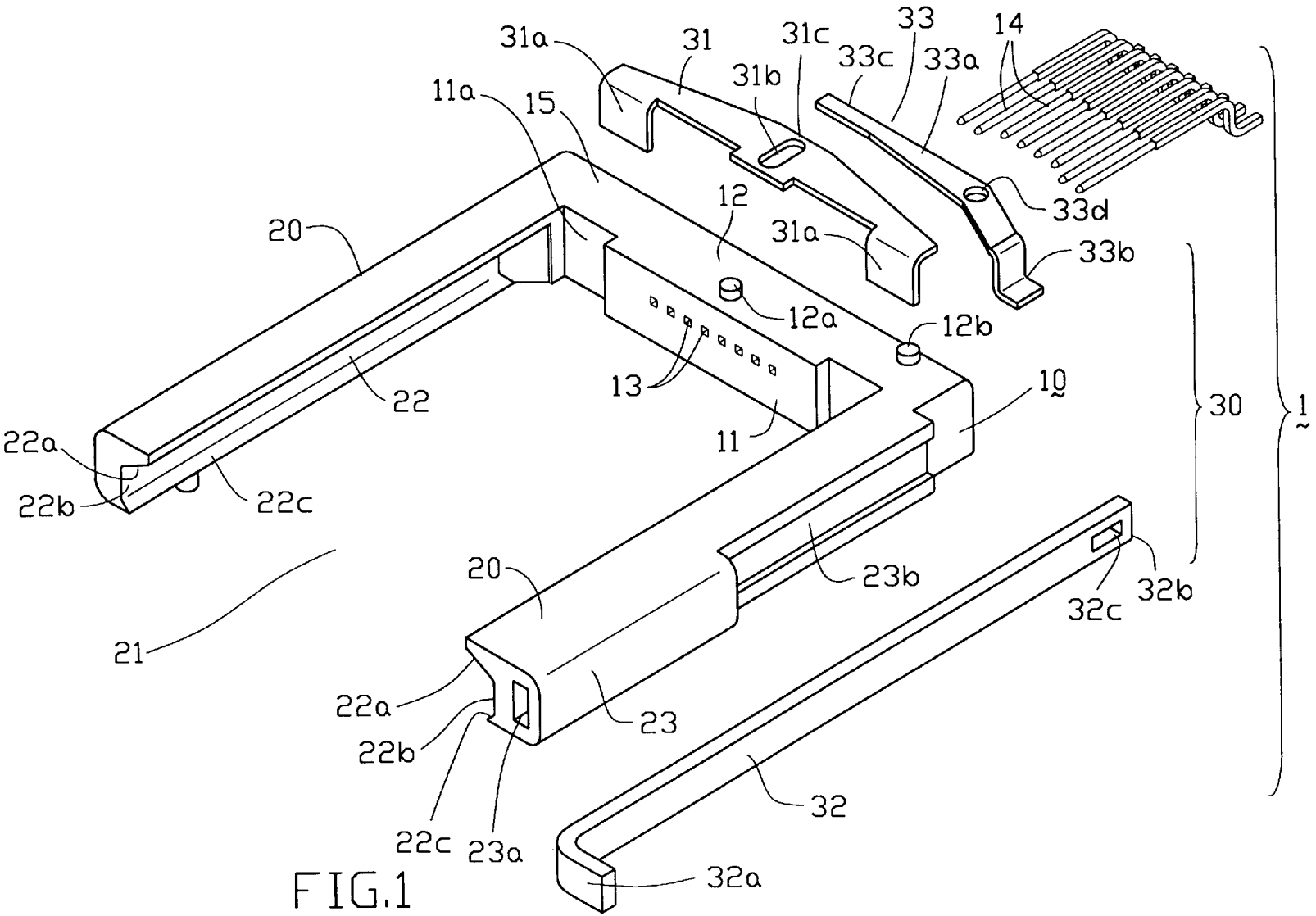
FIG. 1 is an exploded perspective view of a card cartridge connector in accordance with the present invention.

Referring to FIG. 1, a card cartridge connector 1 having a card ejecting mechanism 30 in accordance with the present invention comprises a housing 10 forming a mating face 11 and a supporting face 12 orthogonal to the mating face 11. A plurality of passageways 13 each receiving a terminal 14 therein is defined through the housing 10. A pair of guiding pillars 20 extend from a traverse ends 15 of the housing 10 and defines a receiving space 21 for receiving a card 40 (FIG. 2) therebetween. Each supporting pillar 20 forms a guiding groove 22 in an inner side (not labeled) thereof. The guiding groove 22 forms a first surface 22*a*, a bottom surface 22*b*, and second surface 22*c* and each surface 22*a*, 22*c* form an angle with respect to the bottom surface 22*b*. In order to prevent a user from inserting the card 40 with an incorrect orientation, the angles are different from each other.

A bulge 23 is formed on one of the guiding pillars 20. The bulge 23 defines a tunnel 23*a* therethrough. A trench 23*b* is defined from an end of the tunnel 23*a* to the traverse end 15 of the housing 10.

The card ejecting mechanism 30 includes an ejecting tab 31 movably supported on a fulcrum 12*a* formed as a pin shaft on the supporting face 12, by means of an elongate hole 31*b* defined in the ejecting tab 31. The ejecting tab 31 forms a biasing pad 31*a* extending downward from each end (not labeled) thereof. The biasing pads 31*a* are detachably supported on the mating face 11. The mating face 11 forms recesses 11*a* thereon for receiving the biasing pads 31*a* therein. By this arrangement, the biasing pads 31*a* are flush with or lower than the mating face 11. The ejecting mechanism 30 further includes a push rod 32 forming a head portion 32*a* and an actuating end 32*b*. The push rod 32 is movably inserted into the tunnel 23*a* and the actuating end 32*b* extends to the traverse end 15 of the housing 10. The actuating end 32*b* further defines a window 32*c* therein.

The ejecting mechanism 30 further includes a linkage 33 pivotably supported on a second fulcrum 12*b* formed as a pin shaft on the supporting face 12, by means of a pinhole 33*d* defined in the linkage 33. The linkage 33 has an elongate body 33*a* forming a bearing end 33*b* and an actuating end 33*c*. The bearing end 33*b* is engaged with the window 32*c* of the push rod 32 and the actuating end 33*c* abuts a bearing portion 31*c* of the ejecting tab 31. It is seen that different from the existing prior arts which generally have their ejecting tab and the linkage arranged in a stacked manner, the ejecting tab 31 and the linkage 33 of the invention are arranged in a coplanar state, thus reducing the thickness of the whole assembly.

Figure 2:
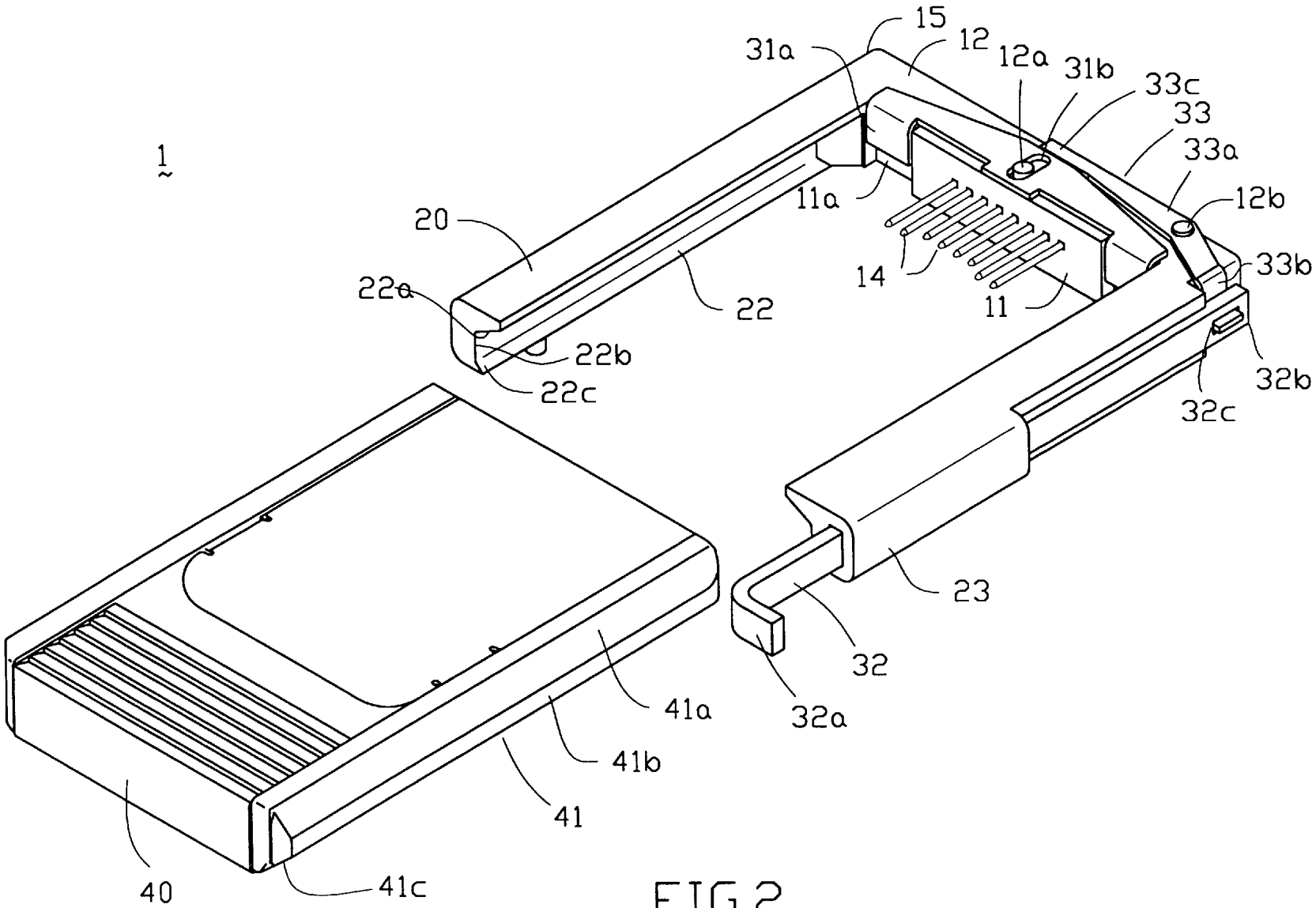
FIG. 2 is an assembled perspective view of the card cartridge connector of FIG. 1 and a smart card to be inserted therein.
Figure 3:
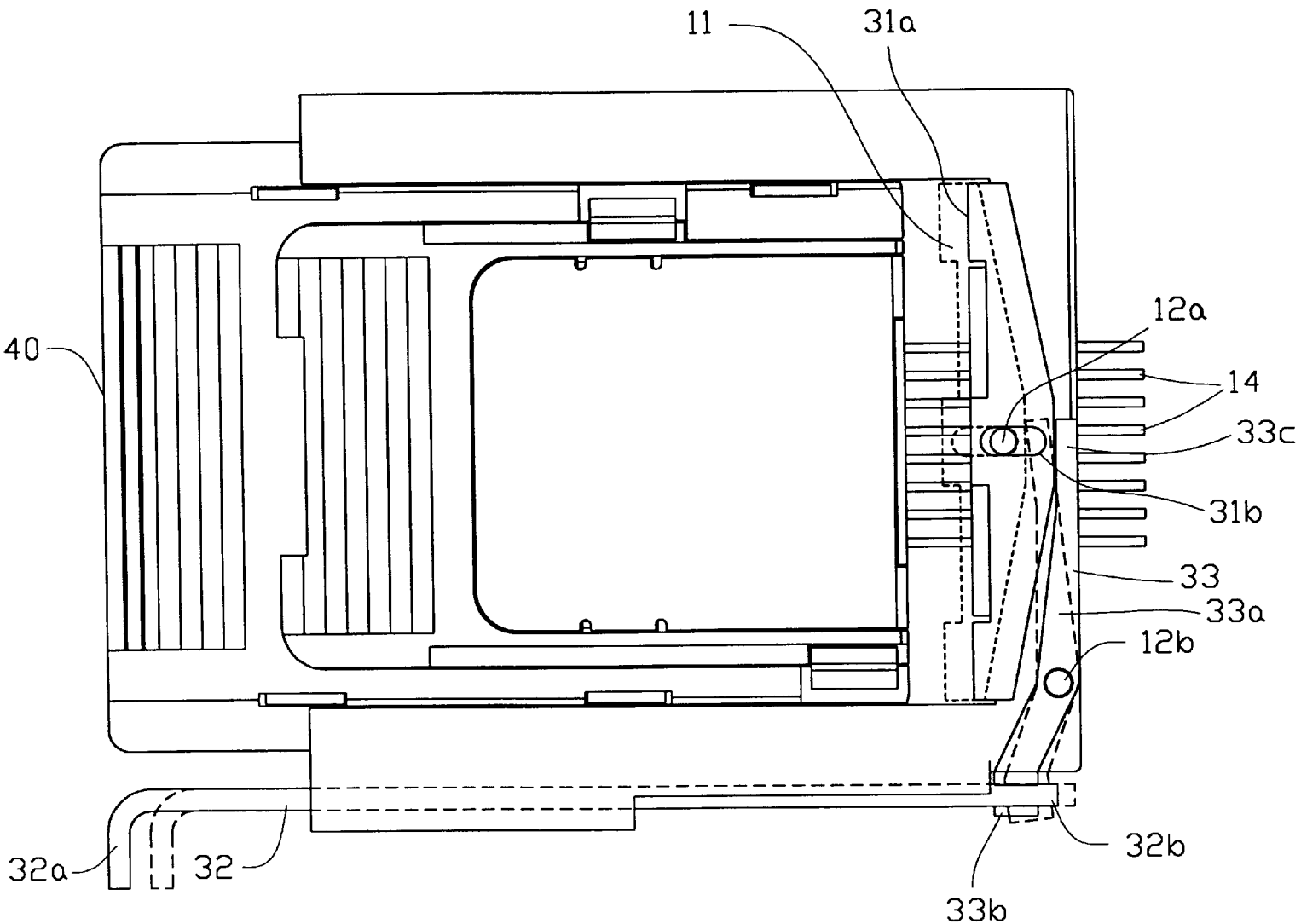
FIG. 3 is a top schematic plan view showing the inserted card being ejected from the card cartridge connector of FIG. 2.

As shown in FIGS. 2 and 3, when the smart card 40 is completely seated, the ejecting tab 31, the linkage 33, and the push rod 32 are located at the position as shown in solid lines. When a user wants to eject the card 40, he/she pushes the head 32*a* toward the cartridge 1 such that the actuating end 33*c* of the linkage 33 abuts the bearing portion 31*c* of the ejecting tab 31 and the ejecting tab 31 accordingly moves forward accordingly as guided by the pin shaft 12*a*. Then the biasing tab 31*a* moves outward from the recess 11*a* and the card 40 is ejected from the mating face 11 of the housing 10. As a portion of the card 40 projects beyond from the cartridge 1, the user may readily grasp and withdraw the card 40 since disconnection from the terminals 14 has already occurred.

The card 40 forms an elongate wedge 41 defining a first surface 41*a*, an outer surface 41*b*, and a second surface 41*c* which correspond to the first surface 22*a*, the bottom surface 22*b*, and the second surface 22*c* of the guiding groove 22, respectively. By this arrangement, the card 40 can only be inserted into the cartridge 1 provided the corresponding surfaces 22*a*, 41*a* contact each other which serves as an anti-disorientation means.

Figure 4:
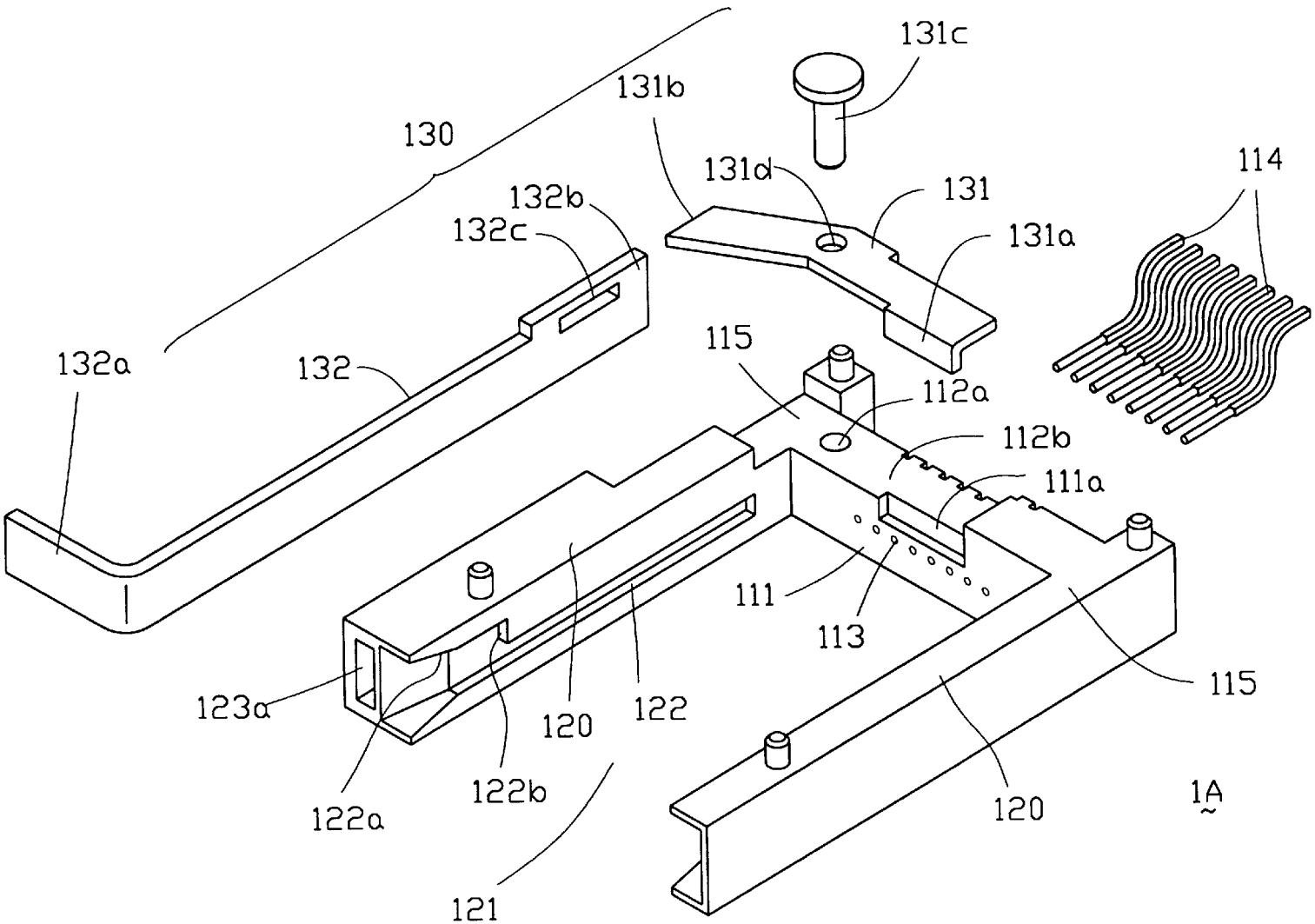
FIG. 4 is an exploded, perspective view of a second embodiment of the card cartridge connector in accordance with the present invention.

Referring to FIG. 4, a second embodiment of the card cartridge connector 1A is shown. The card cartridge connector 1A comprises a housing 110 forming a mating face 111 and a supporting face 112 orthogonal to the mating face 111. A plurality of passageways 113 each receiving a terminal 114 therein is defined through the housing 110.

A pair of guiding pillars 120 extends from traverse ends 115 of the housing 110 and defines a receiving space 121 for receiving a card 140 (FIG. 5) therein. Each supporting pillar 120 forms a guiding groove 122 in an inner side (not labeled) thereof. The guiding groove 122 forms a flared opening 122*a* and a shoulder 122*b*. At least a bulge 123 is formed on one of the guiding pillars 120. The bulge 123 defines a tunnel 123*a* therethrough.

A card ejecting mechanism 130 includes an ejecting tab 131 defining a pivot hole 131*d* therein movably supported on a fulcrum 112*a* formed as a pin hole on the supporting face 112. The ejecting tab 131 has a biasing pad 131*a* extending downward from an end (not labeled) thereof wherein the biasing pad 131*a* is detachably supported on the mating face 111. The mating face 111 forms a recess 111*a* for receiving the biasing pad 131*a* therein. By this arrangement, the biasing pad 131 is flush with or lower than the mating face 111. The ejecting mechanism 130 further includes a push rod 132 forming a head portion 132*a* and an actuating end 132*b*. The push rod 132 is movably inserted into the tunnel 123*a* and the actuating end 132*b* extends to the traverse end 115 of the housing 110. The actuating end 132*b* further defines a window 132*c* therein.

The supporting face 112 forms a recessed surface 112*b* which extends to a portion (not labeled) of the supporting pillar 120. The ejecting tab 131 is pivotably assembled to the recessed surface 112*b* by means of a dowel pin 131*c* extending through the pivot hole 131*d* and the pinhole 112*a*. One end 131*b* of the ejecting tab 132 is received within the window 132*c* of the push rod 132.

Figure 5:
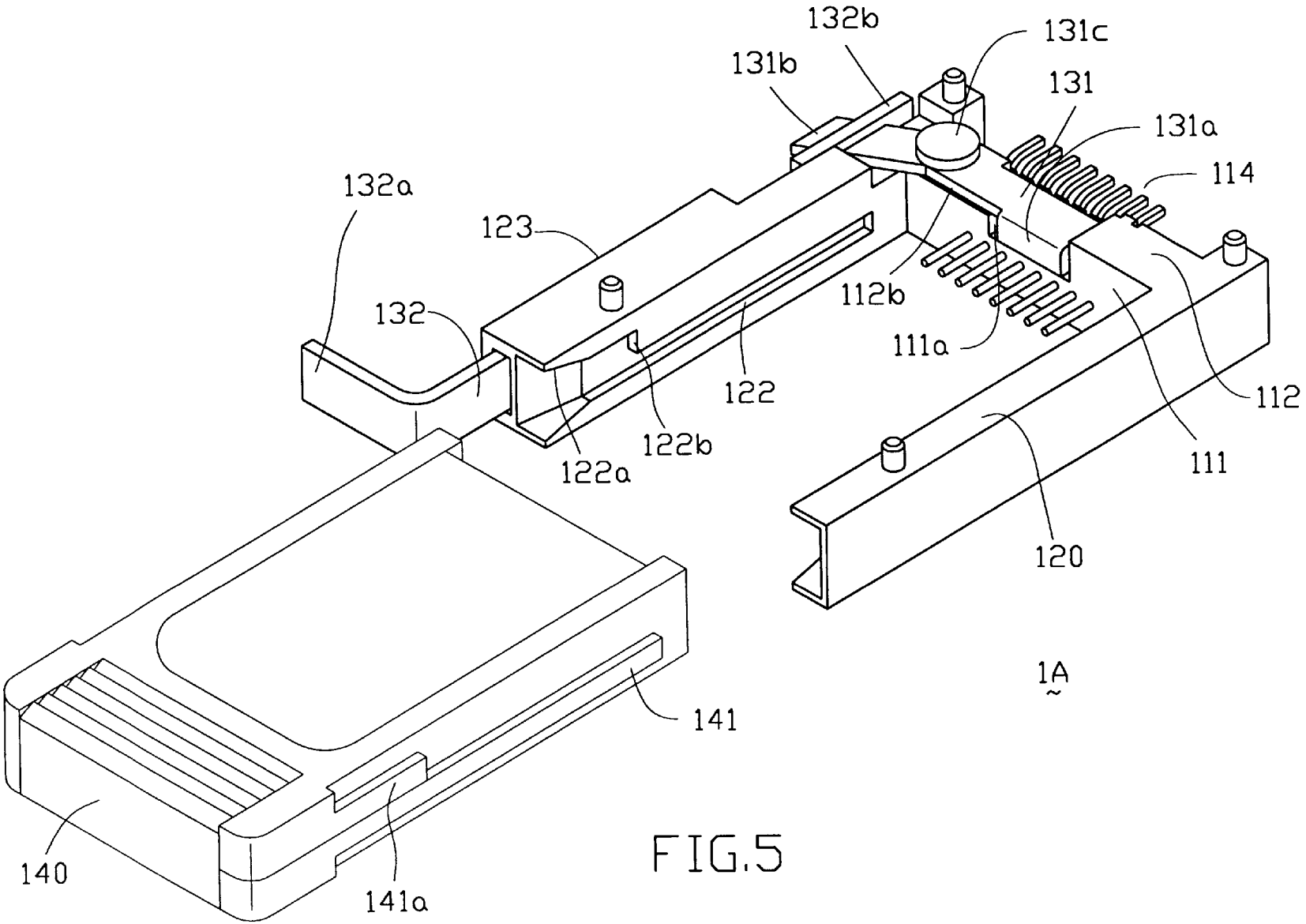
FIG. 5 is an assembled, perspective view of the card cartridge connector of FIG. 4 and a card to be inserted therein.

Referring to FIG. 5, the ejecting mechanism 130 is assembled to the housing 110 and is ready to eject an inserted card 140. The card 140 forms a guiding rack 141 on traverse sides thereof. The rack 141 forms a step 141*a* corresponding to the shoulder 122*b* of the guiding groove 122. By this arrangement, the combination of the step 141*a* and the shoulder 122*b* serve as an anti-disorientation means and the card 140 can completely be seated only when the step 141*a* matches with the shoulder 122*b*.

Figure 6:
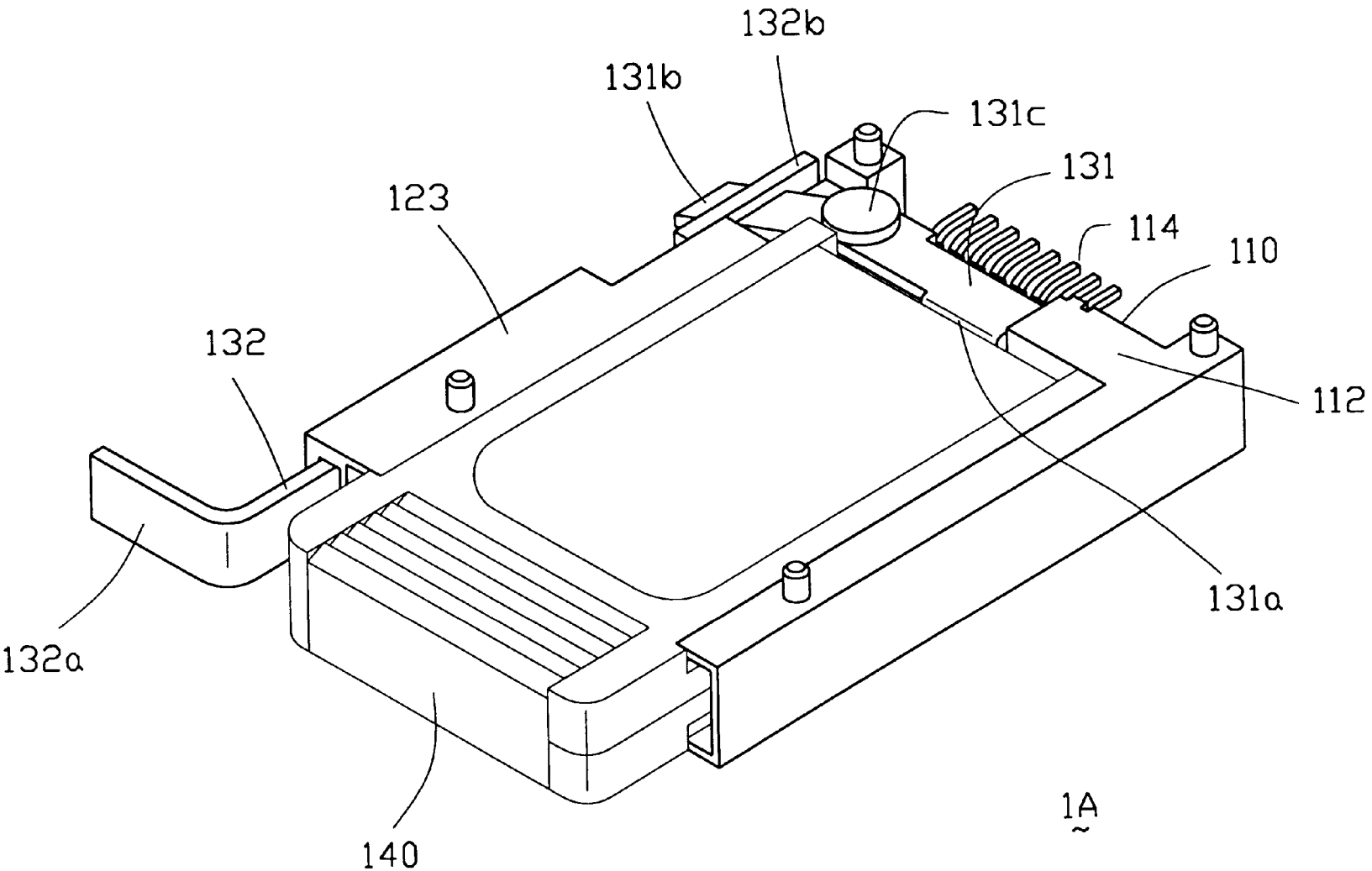
FIG. 6 is a perspective view in which the card is inserted into the card cartridge connector of FIG. 5.

Referring to FIG. 6, when the card 140 is inserted, the biasing pad 131*a* sits into the recess 111*a* on the mating face 111. When the head portion 132*a* is pushed inward, the biasing pad 131*a* will be moved outward whereby the inserted card 140 will be ejected outward.

Figure 7:
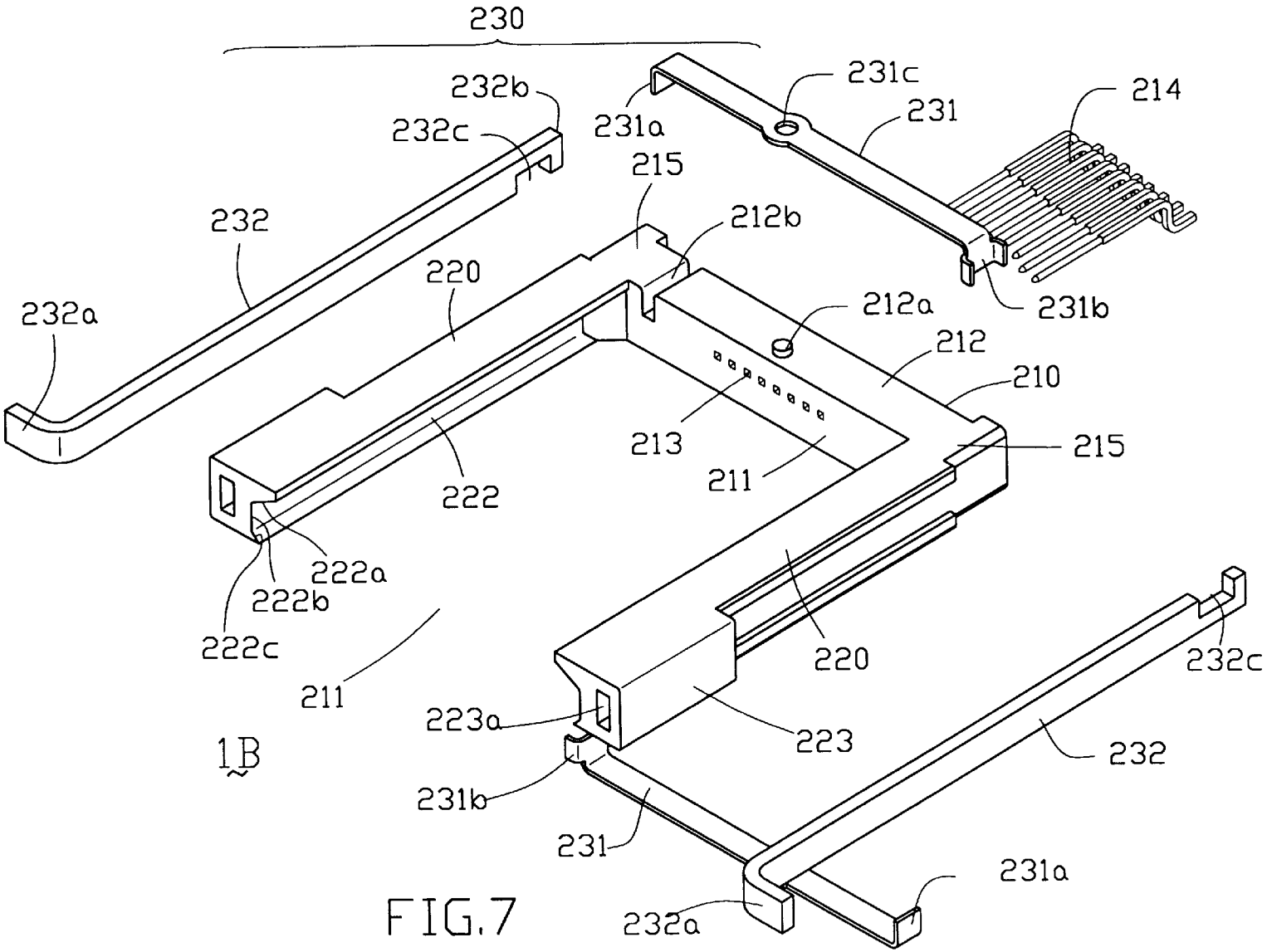
FIG. 7 is an exploded perspective view of a third embodiment of the card cartridge connector in accordance with the present invention.

Referring to FIG. 7, a third embodiment of the card cartridge connector 1B is shown. The card cartridge connector 1B comprises a housing 210 forming a mating face 211 and a supporting face 212 orthogonal to the mating face 211. A plurality of passageways 213 each receiving a terminal 214 therein is defined through the housing 210.

A pair of guiding pillars 220 extend from traverse ends 115 of the housing 210 and defines a receiving space 221 for receiving a card 240 (FIG. 8) therein. Each supporting pillar 220 forms a guiding groove 222 in an inner side (not labeled) thereof. The guiding groove 222 is identical to the guiding groove 22 of the first embodiment therefore a detailed description will not be provided herein. The supporting pillar 220 also has an identical configuration as the supporting pillar 20 of the first embodiment including a bulge 223 defining a tunnel 223*a* therethrough.

A card ejecting mechanism 230 includes an ejecting tab 231 movably supported on a fulcrum 212*a* formed as a pin shaft on the supporting face 212. The ejecting tab 231 has a biasing pad 231*a* extending downward from an end (not labeled) thereof. The supporting face 212 forms a slot 212*b* for receiving the biasing pad 231*a*. When the biasing pad 231*a* is received within the slot 212*b*, the biasing pad 231*a* is flush with or lower than the mating face 211. The ejecting tab 231 forms a pivot hole 231*c* for pivotably receiving onto the fulcrum 212*a* of the housing 210.

The ejecting mechanism 230 further includes a push rod 232 forming a head portion 232*a* and an actuating end 232*b*. The push rod 232 is movably inserted into the tunnel 223*a* and the actuating end 232*b* extends to the traverse end 215 of the housing 210. The actuating end 232*b* further defines a cutout 232*c* for receiving an end 231*b* of the ejecting tab 231 therein.

Figure 8:
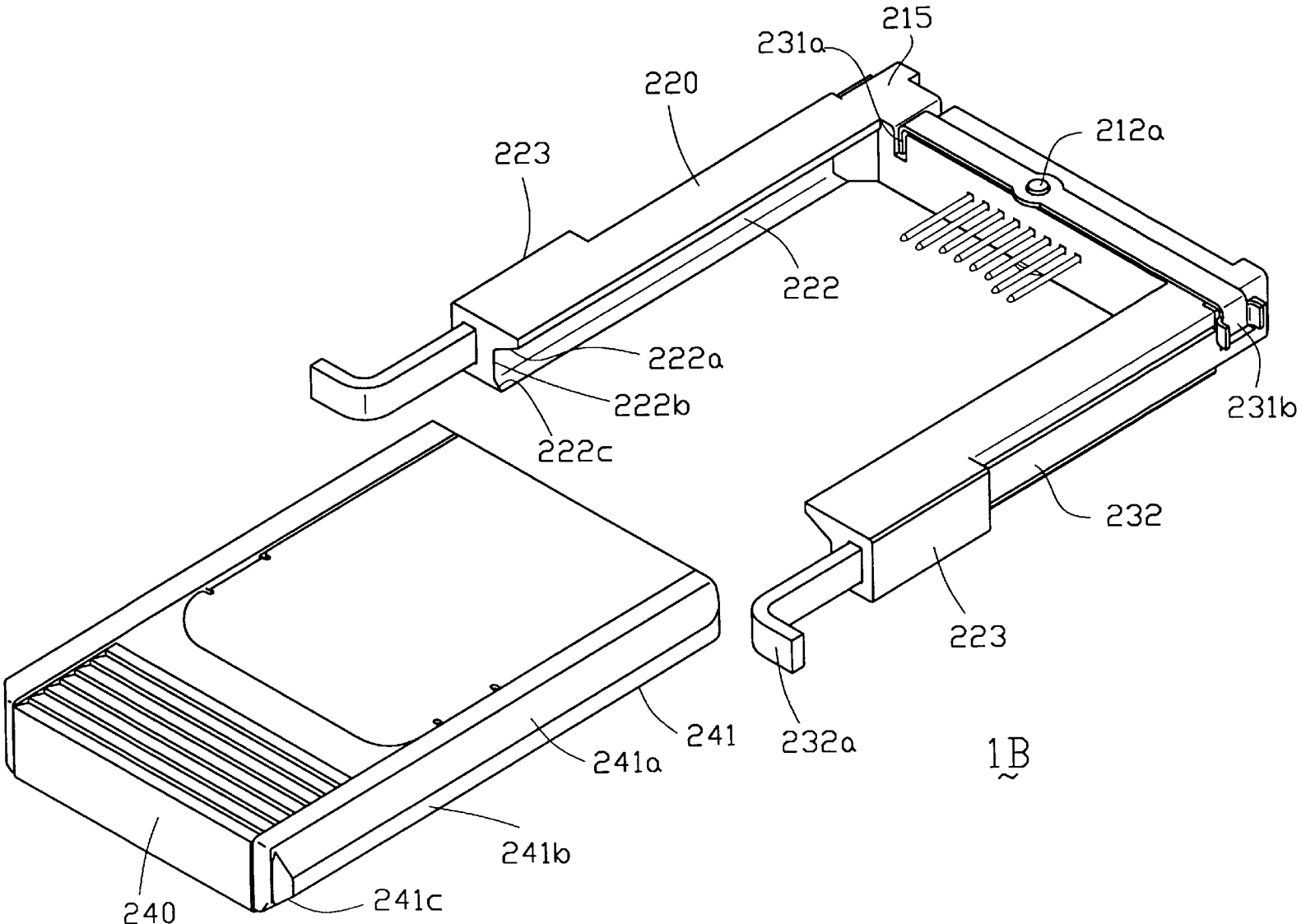
FIG. 8 is an assembled, perspective view of the card cartridge connector of FIG. 7 and a card be inserted therein.

Referring to FIG. 8, the ejecting mechanism 230 is assembled to the housing 210 and is ready to eject an inserted card 240. The card 240 forms an elongate wedge 241 on its traverse side (not labeled).

The wedge 241 defines a first surface 241*a*, an outer surface 241*b*, and a second surface 241*c* which correspond to the first surface 222*a*, the bottom surface 222*b*, and the second surface 222*c* of the guiding groove 222, respectively. By this arrangement, the card 240 can only be inserted into the cartridge 1B provided the corresponding surfaces contact each other which serves as an anti-disorientation means.

While the present invention has been described with reference to specific embodiments, the description is illustrative of the invention and is not to be construed as limiting the invention. Various modifications to the present invention can be made to the preferred embodiment by those skilled in the art without departing from the true spirit and scope of the invention as defined by the appended claims. Therefore, persons of ordinary skill in this field are to understand that all such equivalent structures are to be included within the scope of the following claims.

What is claimed is:

1. A card cartridge connector having a card ejecting mechanism, comprising:

a housing forming a mating face for engaging with an inserted card and a supporting face orthogonal to said mating face, a plurality of passageways each receiving a terminal therein defined through said housing, said supporting face forming at least a fulcrum thereon;

a pair of guiding pillars extending from traverse ends of said housing and defining a receiving space therebetween, each supporting pillar forming a guiding groove in an inner side thereof, at least a tunnel defined in one of said guiding pillars; and a card ejecting mechanism including an ejecting tab pivotably supported on said fulcrum on said supporting face, said ejecting tab having a biasing pad located in a recess of said mating face, a push arm movably disposed within said tunnel and forming a head and an actuating end having an opening defined thereof for engaging an end of said ejecting tab whereby when said push rod is actuated, said biasing pad is moved away from said mating face to push an inserted card outward;

wherein said guiding groove of said supporting pillar forms a first surface, a bottom surface, and a second surface, each first and second surface forming an angle with respect to the bottom surface.

2. A card cartridge connector as recited in claim 1, wherein said fulcrum of said supporting face is a pin shaft and said ejecting tab is pivotably supported thereon by means of a pin hole defined therein.

3. A card cartridge connector as recited in claim 1, wherein said angles are different from each other and serve as an anti-disorientation device for an inserted card.

4. A card cartridge connector having a card ejecting mechanism, comprising:

a housing forming a mating face and a supporting face orthogonal to said mating face, a plurality of passageways each receiving a terminal therein defined through said housing, said supporting face forming at least a fulcrum thereon;

a pair of guiding pillars extending from traverse ends of said housing and defining a receiving space therebetween, each supporting pillar forming a guiding groove in an inner side thereof, at least a tunnel defined in at one of said guiding pillars; and said guiding groove of said supporting pillar forming a first surface, a bottom surface, and a second surface, each first and second surface forming a different angle with respect to said bottom surface for serving as an anti-disorientation device for the inserted card.

5. A card cartridge connector as recited in claim 4, further comprising an ejecting mechanism for ejecting a card inserted into said card cartridge connector.

6. A card cartridge connector as recited in claim 5, wherein said ejecting mechanism includes an ejecting tab movably supported on said supporting face, said ejecting tab having a biasing pad detachably supported on said mating face, a push arm movably disposed within said tunnel and forming a head and an actuating end, said actuating end abutting a bearing portion of said ejecting tab whereby when said push rod is actuated, said biasing pad is moved away from said mating face to push an inserted card outward.

7. A card cartridge connector having two sets of card ejecting mechanism, comprising:

A housing forming a mating face for engaging with an inserted card;

a plurality of terminals extending through the mating face of said housing;

each set of card ejecting mechanism including an ejecting tab, a linkage and a push rod; wherein the ejecting tabs of said two sets of ejecting mechanism are respectively provided on two opposite supporting surfaces of the housing, and the push rods of said two sets of ejecting mechanism are respectively located on two opposite sides of the housing.

8. A card cartridge connector as recited in claim 7, wherein said connector further includes a pair of supporting pillars extending from two ends of the housing, and the push rods are respectively attached to said two supporting pillars, respectively.

9. A card cartridge connector having a card ejecting mechanism, comprising:

a housing forming a mating face for engaging with an inserted card and a supporting face orthogonal to said mating face, a plurality of passageways each receiving a terminal therein defined through said housing, said supporting face forming at least a fulcrum thereon;

a pair of guiding pillars extending from traverse ends of said housing and defining a receiving space therebetween, each supporting pillar forming a guiding groove in an inner side thereof, at least a tunnel defined in one of said guiding pillars; and a card ejecting mechanism including an ejecting tab having an elongate opening movably guided by a first pin shaft formed on said supporting face, said ejecting tab having a biasing pad located within a recess of said mating face, a push arm movably disposed within said tunnel and forming a head and an actuating end, and a linkage pivotably arranged between said ejecting tab and said push arm, said actuating end of said push arm having an opening engaging an end of said linkage which in turn has a bearing end abutting a bearing portion of said ejecting tab, whereby when said push rod is actuated, said biasing pad is moved away from said mating face to push an inserted card outward.

10. A card cartridge connector as recited in claim 9, wherein said supporting face forms a second pin shaft for pivotably supporting said linkage.

* * * * *